US005723215A

United States Patent [19]

Hernandez et al.

[11] Patent Number: 5,723,215

[45] **Date of Patent: *Mar. 3, 1998**

[54] BICOMPONENT POLYESTER FIBERS

[75] Inventors: Ismael Antonio Hernandez, Winterville; William Jonas Jones, Jr., Greenville; Darren Scott Quinn, Goldsboro, all of N.C.

[73] Assignee: E. I. du Pont de Nemours and Company, Wilmington, Del.

[ * ] Notice: The term of this patent shall not extend beyond the expiration date of Pat. No. 5,458,971.

[21] Appl. No.: 794,101

[22] Filed: Feb. 3, 1997

Related U.S. Application Data

[63] Continuation-in-part of Ser. No. 542,974, Oct. 13, 1995, which is a continuation-in-part of Ser. No. 315,748, Sep. 30, 1994, Pat. No. 5,458,971.

[51] Int. Cl.[6] ..... D02G 3/00

[52] U.S. Cl. ..... 428/373; 428/370

[58] Field of Search ..... 428/373, 374, 428/320

[56] References Cited

U.S. PATENT DOCUMENTS

| | | | |
|---|---|---|---|
| 3,328,850 | 7/1967 | Watson | 19/65 |
| 3,520,770 | 7/1970 | Shima et al. | 161/173 |
| 3,772,137 | 11/1973 | Tolliver | 428/369 |
| 3,952,134 | 4/1976 | Watson | 428/391 |
| 4,618,531 | 10/1986 | Marcus | 428/283 |
| 4,794,038 | 12/1988 | Marcus | 428/288 |
| 5,104,725 | 4/1992 | Broaddus | 428/224 |
| 5,112,684 | 5/1992 | Halm et al. | 428/357 |
| 5,458,971 | 10/1995 | Hernandez et al. | 428/373 |

FOREIGN PATENT DOCUMENTS

| | | |
|---|---|---|
| 267684 | 8/1988 | European Pat. Off. . |
| 1168759 | 10/1969 | United Kingdom . |

*Primary Examiner*—Newton Edwards

[57] ABSTRACT

Bicomponent polyester fibers that have "spiral crimp" on account of a difference in chain-branched content of the polyester polymers of the components. Such bicomponent fibers are preferably hollow and may be slickened, such as for use as filling material for pillows or other filled articles.

6 Claims, No Drawings

BICOMPONENT POLYESTER FIBERS

CROSS-REFERENCE TO RELATED APPLICATION

This application is a continuation-in-part of our application Ser. No. 08/542,974 filed Oct. 13, 1995, now allowed (pending), which is itself a continuation-in-part of our application Ser. No. 08/315,748 filed Sep. 30, 1994, now issued as U.S. Pat. No. 5,458,971, the disclosures of which are hereby incorporated herein by reference.

FIELD OF THE INVENTION

This invention concerns improvements in and relating to bicomponent polyester fibers, especially such as may be used as filling materials for pillows and other filled articles, as disclosed in our previous applications, referred to hereinabove, and which may have other uses, as disclosed hereinafter.

BACKGROUND ART

Polyester fiberfill filling material (sometimes referred to herein as polyester fiberfill) has become well accepted as a reasonably inexpensive filling and/or insulating material especially for pillows, and also for cushions and other furnishing materials, including other bedding materials, such as sleeping bags, mattress pads, quilts and comforters and including duvets, and in apparel, such as parkas and other insulated articles of apparel, because of its bulk filling power, aesthetic qualities and various advantages over other filling materials, so is now manufactured and used in large quantities commercially. "Crimp" is a very important characteristic. "Crimp" provides the bulk that is an essential requirement for fiberfill. Slickeners, referred to in the art and hereinafter, are preferably applied to improve aesthetics. As with any product, it is preferred that the desirable properties not deteriorate during prolonged use; this is referred to generally as durability. Hollow polyester fibers have generally been preferred for use as filling fibers over solid filaments, and improvements in our ability to make hollow polyester fiberfill with a round periphery has been an important reason for the commercial acceptance of polyester fiberfill as a preferred filling material. Examples of hollow cross-sections are those with a single void, such as disclosed by Tolliver, U.S. Pat. No. 3,772,137, and by Glanzstoff, GB 1,168,759, 4-hole, such as disclosed in EPA 267,684 (Jones and Kohli), and 7-hole, disclosed by Broaddus, U.S. Pat. No. 5,104,725, all of which have been used commercially as hollow polyester fiberfill filling material. Most commercial filling material has been used in the form of cut fibers (often referred to as staple) but some filling material, including polyester fiberfill filing material, has been used in the form of deregistered tows of continuous filaments, as disclosed, for example by Watson, U.S. Pat. Nos. 3,952,134, and 3,328,850.

Generally, for economic reasons, polyester fiberfill fiber filling material, especially in the form of staple, has been made bulky by mechanical crimping, usually in a stuffer box crimper, which provides primarily a zigzag 2-dimensional type of crimp, as discussed, for example, by Halm et al in U.S. Pat. No. 5,112,684. A different and 3-dimensional type of crimp, however, can be provided in synthetic filaments by various means, such as appropriate asymmetric quenching or using bicomponent filaments, as reported, for example, by Marcus in U.S. Pat. No. 4,618,531, which was directed to providing refluffable fiberballs (often referred to in the trade as "clusters") of randomly-arranged, entangled, spirallycrimped polyester fiberfill, and in U.S. Pat. No. 4,794,038, which was directed to providing fiberballs containing binder fiber (in addition to the polyester fiberfill) so the fiberballs containing binder fiber could be molded, for example, into useful bonded articles by activating the binder fibers. Such fiberballs of both types have been of great commercial interest, as has been the problem of providing improved polyester fiberfill having "spiral crimp". The term spiral crimp has been used in the art, but the processes used to provide synthetic filaments with a helical configuration (perhaps a more accurate term than spiral crimp) does not involve a "crimping" process, in a mechanical sense, but the synthetic filaments take up their helical configuration spontaneously during their formation and/or processing, as a result of differences between portions of the cross-sections of the filaments. For instance, asymmetric quenching can provide "spiral crimp" in monocomponent filaments, and bicomponent filaments of eccentric cross-section, preferably side-by-side but also with one component off-centered, can take up a helical configuration spontaneously.

Polyester fibers having spiral crimp are sold commercially. For instance H18Y polyester fibers are available commercially from Unitika Ltd. of Japan, and 7-HCS polyester fibers are available commercially from Sam Yang of the Republic of Korea. Both of these commercially-available bicomponent polyester fibers are believed to derive their spiral crimp because of a difference in the viscosities (measured as intrinsic viscosity, IV, or as relative viscosity RV), i.e., a difference in the molecular weights of the poly(ethylene terephthalate) polymers used as the different components to make the bicomponent fiber. Use of differential viscosity (delta viscosity) to differentiate the 2 components presents problems and limitations, as has been discussed in our earlier applications. This is primarily because spinning bicomponent polyester filaments of delta viscosity is difficult, i.e., it is easier to spin bicomponent filaments of the same viscosity, and there is a limit to the difference in viscosity that can be tolerated in practice. Since it has been the delta viscosity that has provided the desirable spiral crimp of H18Y and of 7HCS, this limit on the difference that can be tolerated has correspondingly limited the amount of spiral crimp that could be obtained in a delta viscosity type of bicomponent filament. Accordingly it has been desirable to overcome these problems and limitations.

Practically all of the polyester fiber that has been manufactured commercially hitherto has been based on ethylene glycol (2G) and on terephthalic acid (T), and ethylene terephthalate polymers have sometimes been referred to as 2G-T, accordingly. Such polyesters have been preferred because of cost and availability, but others have been mentioned in the literature, such as 3G-T and 4G-T for example. The present invention is not limited to fibers of 2G-T polyesters, but may be applied to other glycol terephthalate polyester fibers, such as of 3G-T or 4G-T, for example.

Crimpable composite filaments were disclosed in 1970 by Shima et al, U.S. Pat. No. 3,520,770, by arranging two different components of polymeric ethylene glycol terephthalate polyesters eccentrically and in intimate adherence to each other along the whole length of the filaments, at least one of the said components being a branched polymeric ethylene glycol terephthalate polyester chemically modified with at least one branching agent having 3 to 6 ester-forming functional groups and at least one of said components being an unbranched polymeric ethylene glycol terephthalate polyester. Shima taught use of such filaments in woven fabrics made of such cut staple filaments. Shima did not teach use of his bicomponent filaments as filling material. Shima did not provide any teaching regarding pillows, nor about filled articles, nor about filling materials.

We have found, as disclosed in our aforesaid applications, the disclosures of which are specifically included by reference, that a difference between the chain-branched contents of polyester components can provide advantages in polyester bicomponent fibers for use as polyester fiberfill filling materials in filled articles, especially in pillows, and in new hollow polyester bicomponent fibers for such use.

We use herein both terms "fiber" and "filament" inclusively without intending use of one term to exclude the other.

Shima taught formulas for calculating upper and lower limits (mole %) for the amounts of his (chain-)branching agents. Shima's upper limit was 9.6/f(f-2), and Shima's lower limit was 0.8/f(f-2), f being the number of ester-forming functional groups of the branching agent that should be used. This meant that, for a trifunctional agent, such as trimethylolethane (or for trimethyl trimellitate, which has been used successfully by us), Shima taught that 0.267 to 3.2 mole % should have been used. For pentaerythritol having 4 functional groups, his limits were 0.1 to 1.2 mole %. Shima taught that, if lower amounts were used, bicomponent filaments having satisfactory crimpability could not be obtained. In contrast to Shima's negative teaching against using lower amounts of chain-branching agent, we have obtained surprisingly good crimpability by using lower amounts of chain-branching agent than Shima taught.

SUMMARY OF THE INVENTION

According to the present invention, therefore, we provide bicomponent glycol terephthalate polyester fibers of helical configuration that has resulted from a difference between chain-branched contents of the glycol terephthalate polyester components of said fibers, wherein any chain-branched glycol terephthalate polyester component is copolymerized with up to 3/4f(f-2) mole % of chain-branching agent, where f is the number of ester-forming functional groups of the chain-branching agent.

As can be seen from the Examples in our aforesaid applications, we have obtained good results by using polymer (B), having 0.14 mole % of trimethyl trimellitate trifunctional chain-brancher, in combination with unbranched homopolymer, polymer (A), and in Example 4 with polymer (C) having an even smaller amount of chain-brancher. 0.14 mole % of a trifunctional chain-brancher is only about half as much as the lowest amount that Shima taught that one had to use to obtain satisfactory crimpability. In contrast to Shima, we prefer to use 1/4f(f-2) to 3/4f(f-2) mole % of the chain-brancher, f being the number of ester-forming functional groups of the chain-branching agent that is used. We prefer to use at least 0.09 mole %, especially at least about 0.1 mole %, and up to about 0.25 mole %, of trifunctional chain-brancher for a chain-branched component to provide a helical configuration. Corresponding amounts of a chain-brancher that has more ester-forming functional groups may be used instead of a trifunctional chain-brancher.

As indicated in our aforesaid applications, pillows are a very significant part of the market for filled articles, but fibers of this invention are useful not only for filling pillows, but for filled articles, more generally, with filling material comprising at least 10%, preferably at least 25%, and especially at least 50% by weight of bicomponent polyester fiberfill fibers of helical configuration that has resulted from a difference between chain-branched contents of polyester components of said bicomponent polyester fiberfill fibers. In particular, preferred such filled articles, according to the invention, include articles of apparel, such as parkas and other insulated or insulating articles of apparel, bedding materials (sometimes referred to as sleep products) other than pillows, including mattress pads, comforters and quilts including duvets, and sleeping bags and other filled articles suitable for camping purposes, for example, furnishing articles, such as cushions, "throw pillows" (which are not necessarily intended for use as bedding materials), and filled furniture itself, toys and, indeed, any articles that can be filled with polyester fiber fill. The remainder of the filling material may be other polyester filling material, which has an advantage of being washable, and is preferred, but other filling material may be used if desired.

Such articles may be filled (at least in part) with fiberballs (clusters), in which the bicomponent polyester fiberfill fibers of helical configuration are randomly entangled into such fiberballs, as a helical configuration has been found preferable for making such fiberballs. Such fiberballs may be moldable, on account of the presence of binder fiber, as disclosed by Marcus in U.S. Pat. No. 4,794,038, for example, and Halm et al in U.S. Pat. No. 5,112,684, or refluffable, as disclosed, for example by Marcus in U.S. Pat. No. 4,618,531 and also by Halm et al.

Also provided are such fiberballs themselves, wherein our bicomponent polyester fiberfill fibers of helical configuration are randomly entangled to form such fiberballs.

Such filled articles also include articles wherein (at least some of) the filling material is in the form of batting, which may be bonded, if desired, or left unbonded.

Such bicomponent polyester fibers are preferably hollow (i.e., contain a single void), and especially with multiple voids, i.e., contain more than one continuous void along the fibers, as has been disclosed in the art. Fibers with round peripheral cross-sections are preferred. Particularly preferred are such fibers having three continuous voids, e.g., as disclosed in our aforesaid applications, with a round peripheral cross-section. We believe no one previously disclosed how to spin round filaments with 3 holes. The invention is not, however, confined to such cross-sections, and other cross-sections, such as triangular and oval cross-sections may also be made and have been made using technology that is known in the art.

Also provided are such new hollow bicomponent polyester fiberfill fibers themselves, and new processes and new spinnerets for making them, and other new processes, including for making filled articles.

Also provided is a process for preparing polyester bicomponent fibers of helical configuration and having one or more continuous voids throughout their fiber length, comprising the steps of post-coalescence melt-spinning polyester components that differ in their chain-branched contents, and that are arranged eccentrically with respect to each other, into filaments through segmented spinning capillary orifices so the resulting freshly-spun molten streams coalesce and form continuous filaments having one or more continuous voids throughout their fiber length, and having an eccentric bicomponent cross-section, and quenching to solidify the filaments, and of developing the helical configuration by drawing the resultant solid filaments and heating to relax them, and preferably such process wherein the fibers are slickened.

Further provided is a process for preparing polyester bicomponent fibers of helical configuration, comprising the steps of melt-spinning polyester components that differ in their chain-branched contents, and that are arranged eccentrically with respect to each other, into filaments through spinning capillary orifices to form continuous filaments having an eccentric bicomponent cross-section, quenching to solidify the filaments, drawing the resultant solid filaments, coating the drawn filaments with a slickener, and heating to relax the filaments and develop the helical configuration.

Such processes for preparing new polyester bicomponent fibers include those wherein the continuous filaments are converted to staple fiber. A particularly advantageous such process includes one wherein the staple fiber is formed into fiberballs having a random distribution and entanglement of fibers within each ball, and having an average diameter of 2–20 mm, and wherein the individual fibers have a length of 10–100 mm.

Bicomponent polyester fiberfill fibers are preferably slickened, i.e., are coated with a durable slickener, as disclosed in the art. So our new slickened bicomponent polyester fiber fill fibers are, themselves, also provided, according to another aspect of the invention. As disclosed in our earlier applications, blends (mixtures) of slickened and unslickened bicomponent polyester fiberfill fibers may have processing advantages.

Further provided, according to another aspect of the invention, are our new bicomponent polyester fibers (having lower amounts of chain-brancher than was taught by Shima) for uses other than as filling material, i.e., such fibers more generally, for instance for textile yarns and other uses.

DETAILED DESCRIPTION OF THE INVENTION

As indicated hereinbefore, the disclosures of our prior applications, now U.S. Pat. Nos. 5,458,971 and U.S. application Ser. No. 08/542,974 filed on Oct. 13, 1995, (pending) now allowed, including the Drawings, are incorporated herein by reference, so it would be redundant to repeat all of their disclosures, but some is repeated hereinafter for convenience. The disclosure by Shima (et al., U.S. Pat. No. 3,520,770) is also incorporated herein by reference. Hereinafter follow comments relative to further differences from Shima's teachings.

Shima preferred to use a terminating (or end-capping) agent with his branching agent, so as to be able to exceed his upper limit of branching agent; we find this unnecessary, at least in our preferred operation, as can be seen, and we prefer to avoid this.

We have used chain-brancher in the polymers used for both components, as demonstrated in our U.S. application Ser. No. 08/542,974, filed Oct. 13, 1995, (pending) now allowed referred to above, in contrast to Shima.

In contrast to Shima's use of equal amounts of the two components, we have used as little as 8% by weight chain-branched 2G-T (using 0.14 mole %), i.e., an 8:92 weight ratio in the bicomponent fiberfill, and believe that we can use even less, e.g., 5%, or even 2%, by weight, so believe weight ratio ranges from 2/98–98/2 may prove useful, preferably 5/95–95/5, especially 8/92–92/8 of the components.

We prefer to match the melt viscosities of the different component polymers that are simultaneously extruded, so far as reasonably possible.

We have found it possible to spin useful filaments with voids, as indicated herein, and also filaments of non-round cross-section. This was not taught by Shima, and we doubt that would have been possible using the technology expressly taught by Shima.

For fiberfill uses, suitable filament deniers will generally range from 1.5 to 20 dtex for the final drawn fibers,, 2–16 dtex being preferred in most cases, and 4–10 dtex being generally most preferred, it being understood that blends of different deniers may often be desirable, especially with the current interest in low deniers (e.g. subdenier fibers), especially for insulating and/or aesthetic purposes.

As indicated, we believe that the bicomponent "spiral crimp" polyester fibers that are commercially available (H18Y and 7-HCS) use both components of ethylene terephthalate homopolymer (2G-T), but with differing viscosities (RV for relative viscosity). We have found that a delta (difference) of about 6 RV units is the only delta that is easily spinnable and that gives good bicomponent spiral crimp, that a delta less than about 6 RV units can be spun but gives low "spiral crimp", whereas it is difficult to spin filaments with a delta higher than about 6 RV units. We believe H-18Y has an average RV of 17.9 LRV (LRV is measured as disclosed in Example 1 of Broaddus U.S. Pat. No. 5,104,725) which means that we believe H-18Y is probably a 50/50 side-by-side bicomponent of 2G-T polymers of 15 LRV and of 21 LRV. We believe 7-HCS has an average LRV of 15, which means that we believe 7-HCS is probably a 50/50 side-by-side bicomponent of 2G-T polymers of 12 LRV and of 18 LRV. In contrast, with a combination of chain-branched and unbranched 2G-T polymers we can spin filaments according to the invention of equivalent LRVs, and indeed the LRV of the blend of polymers that we used in our Examples was measured at 22.7.

Of particular interest, as indicated in our earlier applications and herein, are round multivoid bicomponent filaments according to the invention and slickened bicomponent filaments according to the invention.

TEST METHODS

The parameters mentioned herein are standard parameters and are mentioned in the art referenced herein, as are methods for measuring them.

Properties of the fibers were mostly measured essentially as described by Tolliver in U.S. Pat. No. 3,772,137, except as explained by Hernandez in U.S. Pat. No. 5,458,971, which is incorporated herein by reference. Thus, the BL1 and BL2 heights are measured in inches, BL1 at 0.001 psi (about 7 $N/m^2$), and BL2 at 0.2 psi (about 1400 $N/m^2$). Metric equivalents are given, as needed after conventional units. Crimp takeup (CTU) was measured as follows:

ROPE CRIMP TAKE-UP

A rope of known denier at least 1.5 meters in length is prepared for measurement by placing a knot in both ends. The resulting sample is subjected to a load of 125 mg/den. Two metal clips are placed across the extended rope at a distance apart of exactly 100 centimeters. The two ends of the rope are cut off within 1–2 inches beyond the clips. The resulting cut band is hung vertically and the recovered crimped length between the clips is measured to the nearest 0.5 centimeters. Crimp take-up is calculated using the following equation $$\% CTU = \frac{A - B}{A} \times 100$$

where A is the extended length, 100 centimeters, B is the retracted crimp length in centimeters. When the crimp is completely recovered to its initial crimped length, then %

CTU is identical to % Crimp Index as described by Clarke in U.S. Pat. No. 3,595,738.

Friction, was measured by the SPF (Staple Pad Friction) method, as described hereinafter, and for example, in allowed U.S. application Ser. No. 08/542,972 (DP-6320-C), referred to above.

As used herein, a staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass.).

The staple pad is prepared by carding the staple fibers (using a SACO-Lowell roller top card) to form a batt which is cut into sections, that are 4.0 ins in length and 2.5 ins wide, with the fibers oriented in the length dimension of the batt. Enough sections are stacked up so the staple pad weighs 1.5 g. The weight on top of the staple pad is of length (L) 1.88 ins, width (W) 1.52 ins, and height (H) 1.46 ins, and weighs 496 gm. The surfaces of the weight and of the base that contact the staple pad are covered with Emery cloth (grit being in 220–240 range), so that it is the Emery cloth that makes contact with the surfaces of the staple pad. The staple pad is placed on the base. The weight is placed on the middle of the pad. A nylon monofil line is attached to one of the smaller vertical (W×H) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/min. The staple pad, the weight and the pulley are also moved down with the base, which is mounted on the lower crosshead. Tension increases in the nylon monofil as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the Emery cloth at the interfaces with the staple pad, there is little relative motion at these interfaces; essentially any motion results from fibers within the staple pad moving past each other.) The threshold force level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

The invention is further illustrated in the Examples in our earlier applications as aforesaid, now U.S. Pat. Nos. 5,458,971 (DP-6320) and U.S. application Ser. No. 08/542,978 filed Oct. 13, 1995, now allowed, (pending ) (DP-6320-C), as well as in the following Examples, which primarily compare 2G-T polymer fibers with the results obtained by Shima. As has been indicated, the present invention is not limited to fibers of 2G-T polyesters, but may be applied to other glycol terephthalate polyester fibers, such as of 3G-T or 4G-T, for example. All parts and percentages are by weight, unless otherwise indicated; void contents for products according to the invention were measured by volume, as described by Most in U.S. Pat. No. 4,444,710, but conventionally are often given by area, as described by Broaddus in U.S. Pat. No. 5,104,725. The spinneret capillary used for spinning 3-hole polyester fiber in the Examples was as illustrated and described in U.S. Pat. No. 5,458,971.

EXAMPLE 1

Bicomponent fibers according to this invention were prepared from two different glycol terephthalate polyester polymers, each having an IV of 0.66, essentially as described in Example 1 of U.S. Pat. No. 5,458,971, except as indicated. One component (A) was polyethylene terephthalate homopolymer (without chain-brancher). The other component (B) was ethylene terephthalate polymerized with the addition of 0.13 mole % of trimellitate chain-brancher (added as trihydroxyethyl trimellitate). Each was processed simultaneously through a separate extruder at a combined rate of 182 lbs./hr. (83 kg/hr.) per spin cell. Use of bicomponent metering and distribution plates allowed bicomponent spinning of these polymers in a side-by-side manner in each of 1176 spinneret capillaries within each spinning cell. The flow of these two polymers was controlled at a rate to give a polymer ratio of 78% A and 22% B at a throughput of 0.155 lb/hr./capillary (0.07 kg/hr/capillary). Each spinneret capillary was designed such as to give three continuous, equi-spaced and equi-sized voids throughout the length of the filament and parallel to the filament's central axis. The resulting hollow filaments were quenched with 1250 cfm (35 $m^3$/min) of 55° F. (18° C.) air per cell blowing across the filaments. The filaments had a void content of 12.5% and were spun at 500 ypm (457 mpm). The filaments were observed to exhibit no kneeing or bending as they left the spinneret capillaries, and yarn breakage was not a problem. The spun fibers were then grouped together to form a rope with a drawn/relaxed tow denier of 1,270,000 (1,410,000 dtex) and drawn through a wet draw bath maintained at 90° to 98° C. using a draw ratio of 3.15 X. The drawn filaments were coated with a polyaminosiloxane slickening agent and laid down on a conveyor. Spiral crimps were observed at the point of lay down. This helical fiber was then processed through a drying oven operating at 170° C. after which it was cooled and an antistatic finish was applied.

This fiber was found to have the physical properties given in Table 1A.

TABLE 1A

| | |
|---|---|
| DPF (dtex) | 8.75 (9.7) |
| TBRM BL1 in (cm) | 5.1 (13) |
| TBRM BL2 in (cm) | 0.8 (2) |
| SPF | 0.442 |
| CPI (CPcm) | 7.3 (2.9) |
| CTU | 38% |

In addition, these fibers were tested for crimps using the methods described by Shima in U.S. Pat. No. 3,520,770. The average results of 10 single filament Shima measurements are given in Table 1B for the fibers of the invention (INV) and the data given in Shima's Table 1 are also listed for purposes of comparison; Shima's bicomponent fibers contained equal amounts (50/50) of the components in contrast to the 78/22 proportions for the fibers of Example 1 of our invention.

TABLE 1B

| | INV | SHIMA I | SHIMA II |
|---|---|---|---|
| Number of Crimps (per 25 mm) (Shima) | 9.2 | 10.5 | 13.1 |
| Apparent Percentage Crimp (Shima) | 16.9% | 16.8% | 18.2% |
| Residual Percentage Crimp (Shima) | 16.4% | 16.5% | 15.5% |
| Crimp Elasticity (Shima) | 97% | 98% | 92% |

EXAMPLE 2

Bicomponent filaments were spun according to the present invention essentially as described in Example 1 with the exception that the combined polymer throughput was 210 lb./hr. (95.3 kg/hr.) per spin cell, 0.18 lb./hr./capillary (0.08 kg/hr/capillary), and the polymer ratio A:B was 89:11, and were found to have physical properties as shown in Table 2.

TABLE 2

| | |
|---|---|
| DPF (dtex) | 6.8 (7.5) |
| TBRM BL1 in (cm) | 5.9 (15) |
| TBRM BL2 in (cm) | 0.4 (1) |
| SPF | 0.213 |
| CPI (CPcm) | 3.1 (1.2) |
| CTU | 42% |
| Number of Crimps (per 25 mm) (Shima) | 4.3 |
| Apparent Percentage Crimp (Shima) | 16.9% |
| Residual Percentage Crimp (Shima) | 16.9% |
| Crimp Elasticity (Shima) | 100% |

The fiber produced in this Example was found to have excellent high amplitude, low frequency, crimp formation, such as is extremely useful for filled articles and other uses where a soft hand is required.

As can be seen from the above data, the fibers of both Examples 1 and 2 of our invention exhibited excellent and useful crimp even though the amount of chain-brancher present in polymer B was only about half the required minimum taught by Shima, and even though polymer B comprised only 22% of our fiber in our Example 1 and only 11% of our fiber in our Example 2. In addition, we used no monofunctional compound to prevent problems such as kneeing and yarn breakage as taught by Shima. The melt viscosities of our two polymers were controlled during polymer formation so they were similar, despite the addition of chain-brancher to the B polymer.

We claim:

1. Bicomponent fibers, wherein each component is glycol terephthalate polyester, and wherein the fibers are of helical configuration that has resulted from a difference between chain-branched contents of the glycol terephthalate polyester components of said fibers, wherein at least one glycol terephthalate polyester component is copolymerizod with up to 3/4f(f-2) mole % of chain-branching agent, where f is 3 to 6 and is the number of ester-forming functional groups of the chain-branching agent.

2. Bicomponent polyester fibers according to claim 1, wherein said f is 3.

3. Bicomponent polyester fibers according to claim 2, wherein said chain-branched glycol terephthalate polyester component is copolymerized with at least 0.1 mole % and up to 0.25 mole % of chain-branching agent.

4. Bicomponent polyester fibers according to claim 1, wherein the fibers contain one or more continuous voids along the fibers.

5. Bicomponent polyester fibers according to claim 1 of round peripheral cross-section.

6. Bicomponent polyester fibers according to claim 5, wherein the fibers contain three continuous voids along the fibers.

* * * * *